US008814716B2

(12) United States Patent
Pennington

(10) Patent No.: US 8,814,716 B2
(45) Date of Patent: Aug. 26, 2014

(54) GOLF PRACTICE DEVICE

(75) Inventor: Stan Pennington, Atlanta, GA (US)

(73) Assignee: Intelliturf, Inc., Atlanta, GA (US)

( * ) Notice: Subject to any disclaimer, the term of this patent is extended or adjusted under 35 U.S.C. 154(b) by 22 days.

(21) Appl. No.: 13/544,636

(22) Filed: Jul. 9, 2012

(65) Prior Publication Data

US 2014/0011603 A1 Jan. 9, 2014

(51) Int. Cl.
*A63B 69/36* (2006.01)

(52) U.S. Cl.
USPC ..... 473/278; 473/157

(58) Field of Classification Search
USPC ..... 473/150, 157, 278, 279
See application file for complete search history.

(56) References Cited

U.S. PATENT DOCUMENTS

| | | | | | |
|---|---|---|---|---|---|
| 3,104,879 | A * | 9/1963 | Jetton | 473/153 |
| 3,414,266 | A * | 12/1968 | Mitchell | 473/278 |
| 3,669,454 | A * | 6/1972 | Kolonel | 473/162 |
| 3,814,439 | A * | 6/1974 | Simon | 473/196 |
| 3,885,795 | A * | 5/1975 | Brewer | 473/165 |
| 6,004,219 | A * | 12/1999 | Peabody | 473/157 |
| 6,106,409 | A * | 8/2000 | Jackson, Jr. | 473/278 |
| 7,140,936 | B2 * | 11/2006 | Roberts | 441/36 |
| 2002/0098899 | A1 * | 7/2002 | Newcomb et al. | 473/157 |
| 2003/0208954 | A1 * | 11/2003 | Bulk | 47/39 |

* cited by examiner

*Primary Examiner* — Nini Legesse
(74) *Attorney, Agent, or Firm* — McClure, Qualey & Rodack, LLP

(57) ABSTRACT

A golf practice device having a simulated putting green surface having artificial turf that is approximately the same height and an appearance similar to an actual grass putting surface. Surrounding the putting surface is a collar of artificial turf with grass blades that are longer than the putting surface portion. The turf surfaces may have the ability to float or a floatable substrate can be disposed below the turf for using the device as a floating target for golf shots.

14 Claims, 2 Drawing Sheets

GOLF PRACTICE DEVICE

BACKGROUND

The game of golf is unique in that the fewer times a player hits a golf ball, the more fun they have playing the game. The objective is to get the ball into the hole in as few strokes as possible. Research done on the game proves that approximately 65% of the strokes made by a player during an 18-hole round occur from 100 yards in. Thus, what is termed the "short game" plays an enormous part in the ultimate golf score for an 18-hole round Over the many years golf has been played, thousands of books and articles have been written that are devoted to golf instruction. There are thousands of golf professionals who devote their careers to teaching the game to professionals and amateurs alike. Also in the realm of teaching aids are countless inventions designed to either make the game easier to play or to help the golfer improve by way of using the device during practice or during actual play. In addition, there exist myriad practice and playing facilities with golf ball driving ranges, practice sand traps, practice putting greens, and computer simulators; all designed to help the millions of golfers in the world enjoy the game more by effectively playing it less.

Regardless of what approach a golfer takes in their efforts to improve, whether it be lessons, new equipment, or the latest golf invention, the primary constant if one desires to improve their golf game is quite simple. In order to improve, a golfer must practice. While golf can be an immensely enjoyable endeavor, whether the player is a professional or an amateur, it can also be incredibly difficult.

A typical beginning golfer who is serious about achieving even a modest playing ability would begin by obtaining golf clubs at least somewhat suited to their physique. Properly fitted clubs take into account a golfer's height, weight, strength, sex, and level of natural ability possessed by the individual. Having acquired the equipment, the next step would be to take golf lessons from a professional or other instructor. From this point; however, it is highly unlikely that any individual will develop proficiency in the game if they do not practice what they have been taught or have read in an instruction book.

As golf practice can be tedious and tiring, many efforts have been made in the past to make practice enjoyable. It is to this end that the present device is directed.

SUMMARY

It is therefore, an object of the present device to make golf practice enjoyable and entertaining.

Another object is to provide a practice device that does not require a great deal of space and that can be easily transported or moved around during the use thereof.

A further objective is to enable a golfer to practice the "short game", which accounts for approximately 65% of the total golf score.

A still further objective is to provide a golf practice device that is relatively inexpensive to produce and maintain and which is durable to provide a long service life.

These and additional objectives are attained by the present golf practice device which relates to a simulated putting green surface having artificial turf that is approximately the same height and an appearance similar to an actual grass putting surface. Surrounding the putting surface is a collar of artificial turf with grass blades that are longer than the putting surface portion. This simulates the "fringe" around the green, as it is commonly referred to in the game of golf. The collar may also be referred to as the "rough", as the grass is longer, i.e., rougher, than the grass of the putting green.

The present device may have an underlying support member to provide rigidity to the artificial turf surfaces or the artificial turf surfaces may have their own degree of rigidity in order to help provide structure for the device. In one embodiment, the support member can be a foam board that is rigid or semi-rigid and relatively lightweight. In another embodiment, the foam board may enable the overall combination to float so that it can be used in a swimming pool, lake, pond, or the like.

Various additional objects and advantages of the present device will become apparent from the following detailed description, with reference to the accompanying drawings.

DETAILED DESCRIPTION

Figure 1:
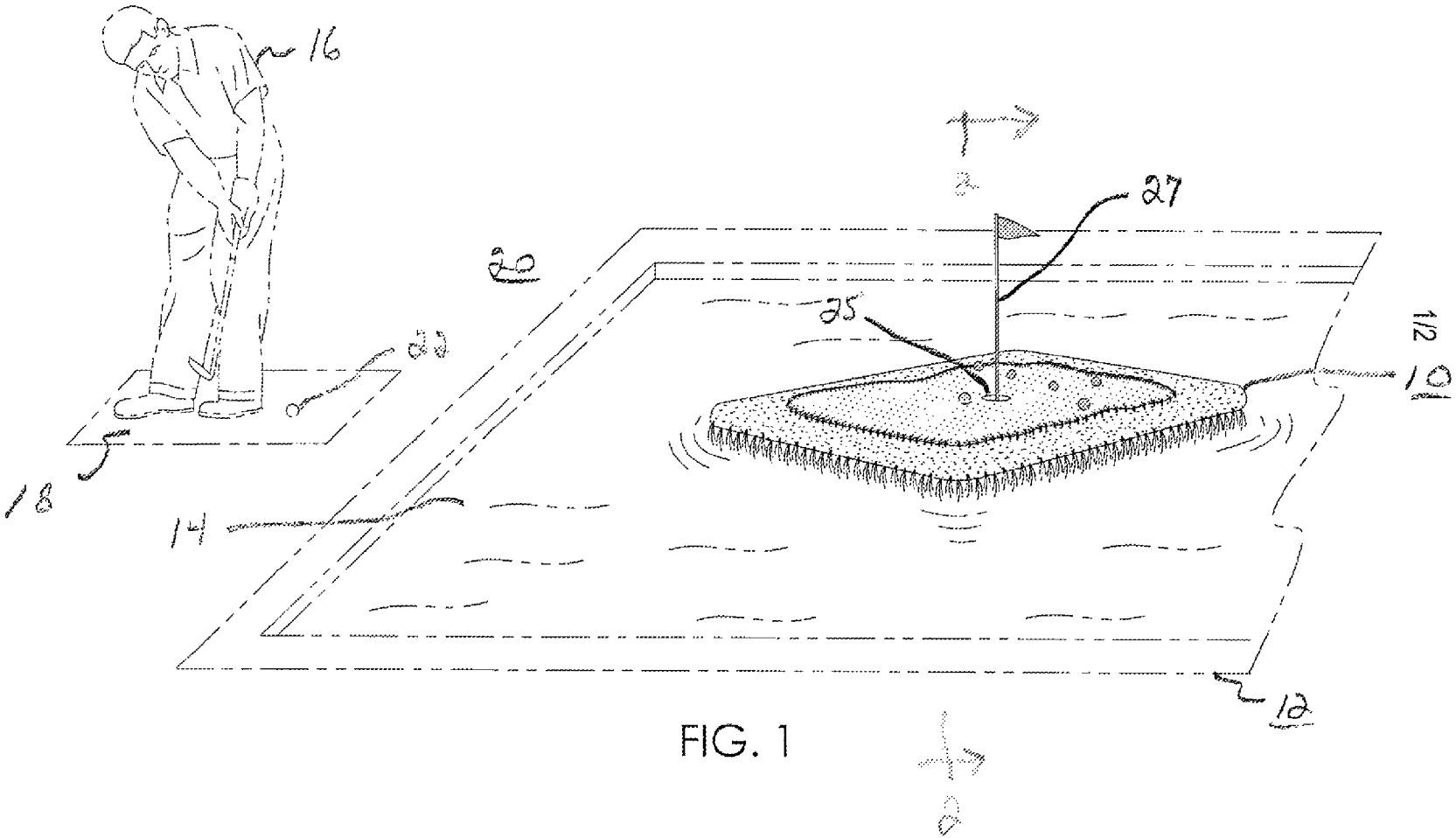
FIG. 1 is a perspective view, shown with certain features in phantom lines, of the present golf practice device.

Referring now more specifically to the drawings, and to FIG. 1 in particular, numeral 10 designates generally the novel golf practice device. In the embodiment shown, the device is floating in a swimming pool 12, maintained on the surface of the water 14 by a floatation means that is described hereinbelow. A golfer 16 is shown standing next to the pool on a mat 18, which may be made of artificial turf, that itself is placed on the pool deck 20. Typically, the golf balls 22 that would be used in this embodiment have the ability to float on the water; however, this is not a requirement. The description which follows will focus on an embodiment of the golf practice device that is designed to float on the surface of a liquid, as the water in a swimming pool, lake, or the like. However, it is contemplated, within the scope of the disclosure, that the present device can also be placed on solid ground outdoors, or inside in a house, practice facility, school, etc. Similarly, the description notes the use of a mat, such as mat 18, as a surface from which to hit practice golf shots. However, the ball can be hit from actual turf near the water, sand, or in the case of an indoor facility, from a mat or carpeting.

Figure 2:
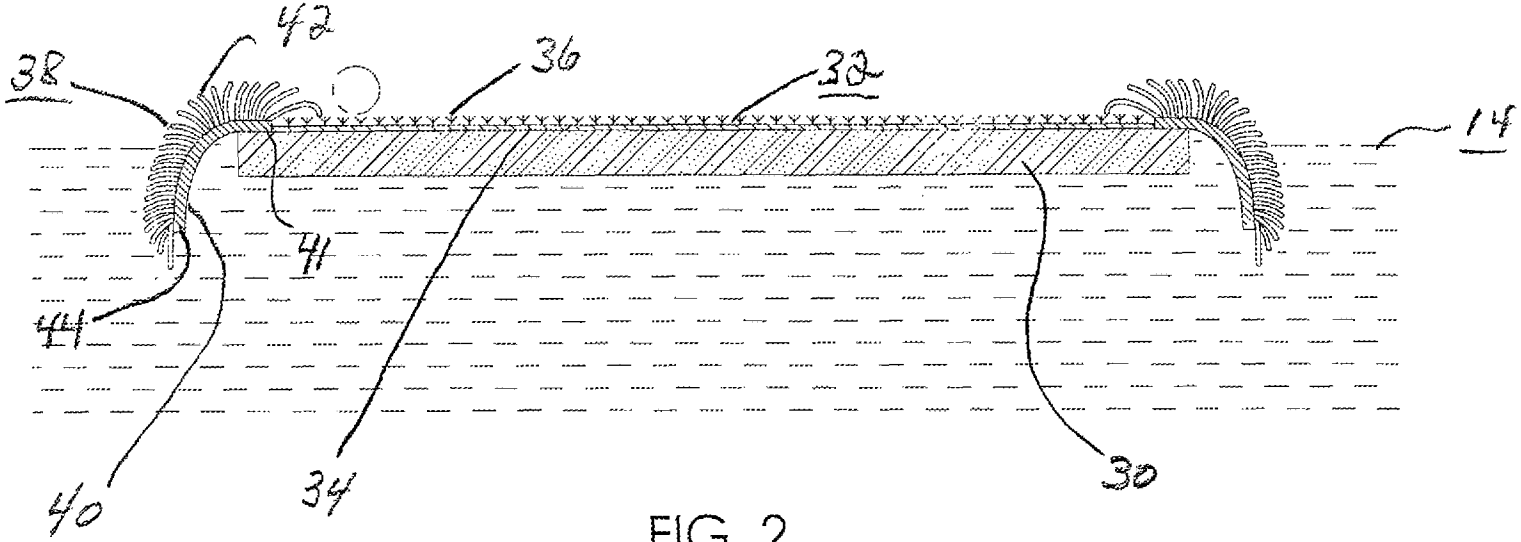
FIG. 2 is a cross-sectional view, taken along line 2-2 of FIG. 1.

FIG. 2 illustrates the embodiment of the present golf practice device that is designed for floatation on the surface of the water 14. The device includes a flotation means such as substrate 30, which in this case, is a foam board. Any suitable material that floats can be used for the substrate, such as polystyrene, recycled or not, closed cell foam, an air bladder, or other means. Secured to the substrate with a waterproof adhesive (not shown), is a simulated, artificial grass, golf putting surface 32, which will be herein referenced as the "green". Other means of securing are also contemplated, including mechanical fasteners, hook and loop type fasteners, and other means for securing. The green itself has a supporting base 34, upon which are secured short blades of grass 36. The height of the short blades of grass may be, for example, one quarter of an inch or less, to simulate an actual golf green. The material used for the artificial grass may be green in color, as is typically the case in nature, or they can be any desired color, include logos of favorite sports teams or golfers, have product logos when used as a promotional device, and so on. While shown here with a foam board substrate 30, the substrate can also be the supporting base 34 and/or the fringe base 40. If the base layer or layers themselves serve as the substrate, they can be made from materials that float, if the present device is to be used in a body of water.

Surrounding the putting surface is a collar or fringe 38, also made out of artificial grass. In general, the grass comprising the fringe will have a height that is greater than the grass comprising the putting surface, in order to provide a demarcation between the two surfaces. The grass blades making up the fringe may all be one height, or they can be staggered, getting progressively shorter as the distance to the putting surface decreases. In golf terms, this is referred to as the first cut, second cut, and so on. The fringe shown here has a base 40, the proximal edge 41 of which is secured to substrate 30, and to which are secured grass blades 42. Grass blades 42 have a length that is typically between one-half inch to two inches. Shorter or longer grass blades 42 may be employed, with a length of approximately one inch working particularly well. The blades 42 may all extend vertically or may be disposed in an angular orientation. The fringe can also partially surround the putting surface portion as an alternate embodiment. The green may include a hole or cup 25 for ultimately receiving the ball, the cup having a flagstick 27 for marking its location on the green. The cup may be regulation size, which is 4.25 inches in diameter, or it may be larger or smaller.

The base 40 of the fringe is somewhat flexible, and the distal edge 44 of the base bends downwardly, by virtue of its own weight, into the water. Grass blades 42 which are secured at or near the proximal edge 41 are disposed inwardly, at an approximately thirty to sixty degree angle, toward the putting surface. Grass blades 42 that are nearer the center of the fringe layer, extend generally upright. The grass blades 42 that are at or near the distal edge 44, extend generally outwardly, away from the putting surface, at an approximately thirty to sixty degree angle, but in the opposite direction.

Thus, while the device is in use, golf balls hit at the practice green that impact the outwardly angled blades of grass of the fringe, are deadened upon impact, with the force in the direction of travel of the shot tending to propel the ball forwardly onto the putting surface. Golf balls hit at the practice green that impact the inwardly angled blades tend to also be deadened and propelled forwardly onto the putting surface. Golf balls hit at the practice green that strike or land on the putting surface may stop on the putting surface if they land softly or with backspin imparted to the ball by the golf club. If the ball does not stop on its own, but bounces forwardly away from the golfer, it may contact the inwardly angled grass blades on the side of the green that is across the green from the golfer. The inwardly angled blades act as a backstop and tend to stop the ball such that it remains on the putting surface. The above-factors which can influence the golf ball, remain constant, regardless of where the golfer is hitting from, i.e., regardless of the direction of travel of the golf shot.

The angular orientation just described can also be reversed. In such a case, the blades of grass closest to the putting surface may be angled outwardly, away from the putting surface. Golf balls hitting these blades nearest the golfer would tend to be propelled forwardly, on to the putting surface and maintained on the putting surface by the outwardly angled blades across the green from the golfer due to the upward "ramp" formed by the blades. Outermost blades having an inwardly angled orientation would perform similarly to blades angled in the opposite direction, deadening an incoming shot. The grass blades 42 can also be oriented substantially vertically, or some combination of the various possible orientations can be employed. An additional variation involves the use of a fringe portion that is attached via a fastening means that can be undone, e.g. a hook and loop fastener. This would allow one fringe portion to be removed and another applied in its place. The replacement fringe portion could have longer blades of grass, shorter blades, different levels in the same fringe portion, etc.

The projection of the fringe 38, downwardly into the water, confers an additional advantage if desired by the practicing golfer. The downwardly projecting fringe is impacted by currents in the pool or other body of water. Currents may be provided by the filter system of the pool or by natural currents in a lake or pond. This causes the device to move in the water and provide a moving target for the golfer. The golfer can thus practice short shots as well as longer shots without shifting the hitting area where the golfer is standing. Where such movement is not desired, the device can be anchored with any suitable fixation means.

In the use and operation of the present golf practice device, the device is first placed in a desired location, whether it be indoors, outdoors, on solid ground or a solid surface, or in a body of water. If in a body of water, the device can be anchored in place or left to freely float. The golfer positions himself or herself a desired distance from the device and chooses a suitable golf club with which to hit approach shots in the form of chip shots, lob shots, pitch shots, etc. As noted earlier, the objective in golf is to get the ball in the hole with the fewest possible strokes. Thus, the golfer is practicing getting the ball on the putting surface, as close to the hole as possible. If the golfer can then transfer the skills learned to an actual golf course, the result should be lower scores and consequently, more enjoyment from the game.

Various competitive practice sessions can be devised by golfers using the device. Points could be awarded for holes-in-one, closest to the pin, landing and stopping the ball on the putting surface, landing and stopping the ball on the fringe, and so on. As there is virtually no substitute for practice if a golfer wishes to improve his or her golf game, the present device introduces a challenging, yet enjoyable, exercise in practicing one of the most important skills in golf.

While an embodiment and modifications thereof have been shown and described in detail herein, various additional changes and modifications may be made without departing from the scope of the present disclosure and the appended claims.

At least the following is claimed:

1. A golf practice device for an individual to hit golf shots onto comprising an artificial grass golf putting surface, having multiple edges having blades of grass with a length that is approximately the same, and all the edges having a surrounding fringe of artificial grass having blades of grass with a length greater than the blades of grass making up the putting surface and said blades of grass of said fringe that are closest to said putting surface are angled inwardly relative to said putting surface for receiving and deadening incoming golf balls.

2. A golf practice device as defined in claim 1 in which said putting surface is mounted on a substrate.

3. A golf practice device as defined in claim 2 in which said substrate is capable of floating in a body of water.

4. A golf practice device as defined in claim 1 in which the putting surface and the fringe have bases that are capable of floating on the surface of a liquid.

5. A golf practice device as defined in claim 4 in which a portion of said blades of grass of said fringe extend vertically for helping to maintain golf balls on said putting surface.

6. A golf practice device as defined in claim 1 in which a portion of the blades of grass of said fringe that are closest to said putting surface are angled inwardly toward said putting surface.

7. A golf practice device as defined in claim 1 in which said fringe and putting surface are capable of floating in liquid.

8. A golf practice device capable of floating in a body of water for an individual to hit golf shots onto said device, comprising a first artificial turf surface with multiple edges, a second artificial turf surface disposed adjacent all the edges thereto, said second turf surface surrounding all the edges having turf with a height greater than that of said first turf surface, portion of said second turf surface extends into the body of water for being acted upon by currents in the water and moving said device through the water and wherein portion of the second turf is angled inwardly relative to the first turf surface and portion of the second turf is angled away from the first portion.

9. A golf practice device as defined in claim 8 in which a flotation means is disposed below said turf surface for supporting the device in the body of water.

10. A golf practice device as defined in claim 9 in which said second turf surface overlies an edge of said flotation means and extends into the body of water.

11. A golf practice device as defined in claim 8 in which said second turf surface has individual blades of grass extending vertically for receiving and deadening incoming golf shots.

12. A golf practice device as defined in claim 8 in which said second turf surface has individual blades of grass extending angularly relatively to said first turf surface for receiving and deadening golf shots.

13. A golf practice device for use by a golfer practicing chip shots by hitting shots onto said device comprising a first artificial turf putting surface portion, a second artificial turf fringe portion at least partially surrounding said putting surface portion and having turf with a greater height relative to said putting surface portion, and a substrate for mounting said putting surface portion and said fringe portion and providing rigidity thereto and in which a portion of said turf having greater height is angled away from said putting surface portion.

14. A golf practice device as defined in claim 13 in which said substrate is capable of flotation in a body of water for use in a pool, pond, or the like.

* * * * *